United States Patent [19]

Cooper

[11] 4,347,041

[45] Aug. 31, 1982

[54] FUEL SUPPLY APPARATUS

[75] Inventor: Paul Cooper, Titusville, N.J.

[73] Assignee: TRW Inc., Cleveland, Ohio

[21] Appl. No.: 56,908

[22] Filed: Jul. 12, 1979

[51] Int. Cl.[3] ..... F04B 23/04; F04B 49/08

[52] U.S. Cl. ..... 417/15; 415/26; 415/61; 417/216; 417/223; 417/429

[58] Field of Search ..... 417/15, 216, 223, 429; 123/139 BA; 415/18, 61, 60, 122 R, 26; 60/330, 347, 357, 358, 364, 365; 244/135 R

[56] References Cited

U.S. PATENT DOCUMENTS

| | | | |
|---|---|---|---|
| 2,546,034 | 3/1951 | Lansing | 417/216 X |
| 2,713,981 | 7/1955 | Lansing | 244/135 R |
| 2,781,727 | 2/1957 | Marshall et al. | 60/39.28 |
| 2,792,192 | 5/1957 | Wheeler | 244/135 R |
| 3,589,836 | 6/1971 | Danker et al. | 417/216 X |
| 3,955,365 | 5/1976 | Arao | 60/358 X |
| 3,961,859 | 6/1976 | Cygnor et al. | 415/18 |

FOREIGN PATENT DOCUMENTS

| | | | |
|---|---|---|---|
| 732522 | 3/1943 | Fed. Rep. of Germany | 417/223 |
| 841642 | 5/1939 | France | 417/223 |

*Primary Examiner*—Carlton R. Croyle

*Assistant Examiner*—Edward Look

*Attorney, Agent, or Firm*—Yount & Tarolli

[57] ABSTRACT

An improved fuel supply apparatus includes a booster pump assembly which is disposed in a fuel tank of an aircraft and is operable to supply fuel to an engine. The rate at which fuel is supplied by the booster pump assembly varies with variations in the demand for fuel by the engine. The booster pump assembly includes a pump having a small volumetric discharge capacity and a second pump having a large volumetric discharge capacity. An electric motor is provided to continuously drive the small pump. A fluid coupling is engaged to connect the large pump with the motor when the discharge pressure from the small pump decreases in response to an increase in demand for fuel by the engine. To engage the fluid coupling, a control assembly directs a flow of fuel to a space between input and output elements of the coupling. When the output pressure from the small pump increases due to a decrease in demand for fuel by the engine, the fluid coupling is drained to disconnect the large pump from the motor. To promote draining of the coupling, the space between the input and output elements of the coupling is vented to tank ullage by the control assembly.

13 Claims, 3 Drawing Figures

FUEL SUPPLY APPARATUS

BACKGROUND OF THE INVENTION

This invention relates to a new and improved fuel supply apparatus and more specifically to a booster pump assembly which is utilized to supply fuel to an aircraft engine.

During operation of a supersonic aircraft, heat rejection to the fuel is such that when there is a low fuel flow rate, the booster pump must deliver the fual at a higher pressure than when there is a high fuel flow rate. These requirements make the utilization of a fixed-geometry pump assembly or a speed-control approach to booster pump construction almost impossible. If a high flow rate booster pump impeller having a large passaget-to-diameter ratio, is driven at a substantially constant speed to supply both the high and low fuel flow rate requirements of an engine, the attendent recirculation power required at a relatively low fuel flow rate is the same or greater than the power consumed at the maximum fuel rate. Of course, this results in relatively inefficient booster pump operation.

Inefficient booster pump operation becomes particularly acute in the case of supersonic military aircraft. In supersonic military aircraft, the booster pump is required to supply relatively high fuel flow rates during take off and/or during afterburner operation. However, these conditions are present during only approximately 5 percent of flight time. Therefore, the booster pump has excess capacity during the remaining 95 percent of the flight time.

During 95 percent of supersonic military aircraft flight time, approximately 2 to 10 percent of booster pump capacity is required to satisfy the fuel requirements of the engine. Therefore, during the large majority of the engine operating time, a booster pump having a fixed-geometry impeller with a large passage-to-diameter ratio is inefficient in operation. In order to solve this problem, it has been proposed to use variable-geometry impellers in the manner disclosed in U.S. Pat. No. 2.950,686 and in U.S. Pat. No. 3,806,278. However, the complexity and/or inherent operating characteristics of these variable-geometry pumps have made them less than completely satisfactory.

SUMMARY OF THE PRESENT INVENTION

The present invention relates to a new and improved apparatus for supplying fuel to an engine and more specifically to a tank mounted booster pump assembly which conserves energy by operating efficiently during both low and high fuel rates to an aircraft engine. In order to accomplish this, the improved booster pump assembly includes a relatively small pump and a relatively large pump. Whe engine fuel flow requirements are relatively low, only the relatively small, low flow capacity pump is operated to supply the engine with fuel. When the engine fuel requirements are relatively high, such as during take off and/or during afterburner operation, both the small pump and the large pump are operated to supply fuel to the engine.

To reduce booster pump power requirements, the large pump is rendered inactive during engine operating conditions requiring a relatively low fuel flow rate. To this end, the large pump is connected with the booster pump drive motor through a fluid coupling assembly. During low fuel flow operating conditions, the fluid coupling assembly is drained and the motor is used to drive only the small pump. When the fuel flow requirements increase, liquid is supplied to the fluid coupling assembly to connect the relatively large pump with the motor.

In accordance with a feature of the present invention, fuel is utilized as the liquid which is supplied to the fluid coupling assembly. The use of fuel as the working fluid which transmits drive forces in the coupling assembly is believed to be particularly advantageous since the entire booster pump assembly is submerged in the fuel tank. This eliminates the need to conduct liquid from a separate source to the coupling assembly when the coupling assembly is to be engaged.

Although many different types of control devices could be utilized to effect engagement and disengagement of the coupling assembly, a fluidic control assembly is advantageously used due to its reliability in operation and lack of moving components. When the coupling assembly is to be engaged, the fluidic control assembly directs a stream of fuel from the relatively small pump to the fluid coupling assembly. When the coupling assembly is to be disengaged, the stream of fuel is directed back to the tank and the fuel in the coupling assembly is vented.

Accordingly, it is an object of this invention to reduce the power requirements of a booster pump assembly during operation of an aircraft.

Another object of this invention is to provide a new and improved apparatus for supplying fuel to an engine and wherein the apparatus includes a pair of fuel pumps and a control assembly which effects operation of a coupling to drive one of the pumps only when necessary.

Another object of this invention is to provide a new and improved apparatus for supplying fuel to an engine and wherein a fuel pump, drive motor and coupling is disposed in a fuel tank, the coupling being of the fluid type and being supplied with fuel as the working fluid.

Another object of this invention is to provide a new and improved apparatus for supplying fuel to an engine and wherein a fuel pump, drive motor and coupling are disposed in a fuel tank, the coupling being of the fluid type and being vented when it is to be disengaged.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
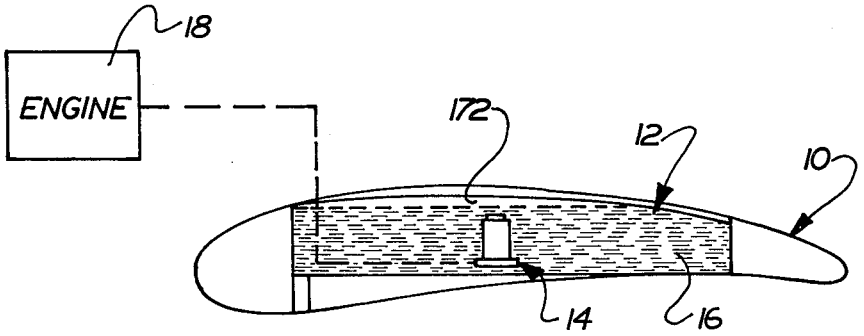
FIG. 1 is a schematic illustration of a tank mounted booster pump assembly constructed in accordance with the present invention.

A portion of an aircraft is illustrated schematically in FIG. 1 and includes a wing 10 having a fuel tank 12 with a booster pump assembly 14 which is utilized to supply liquid fuel 16 from the tank to an aircraft engine 18. Although the booster pump assembly 14 could be mounted in the fuel tank 12 in many different ways, the booster pump assembly is advantageously mounted in a manner similar to that disclosed in U.S. Pat. No. 2,865,539. Although the booster pump assembly 14 could be utilized to supply fuel directly to a carburetor of an engine, the booster pump assembly is used to supply fuel to a metering apparatus which is associated with the engine 18.

The demand for fuel by the engine 18 will vary with aircraft operating conditions. Thus, during take off and/or afterburner operation, the engine 18 will require a relatively large flow of fuel. During level flight at a substantially constant speed, the demand for fuel by the engine 18 is substantially reduced.

During operation of the engine, heat is transferred to the fuel by the engine. When fuel is being conducted at a relatively low flow rate to the engine, the heat rejection conditions are such that the fuel must be at a relatively high pressure. However, when fuel is being conducted at a relatively high flow rate to the engine, the heat rejection conditions are such that the fuel can be at a substantially lower pressure.

Figure 2:
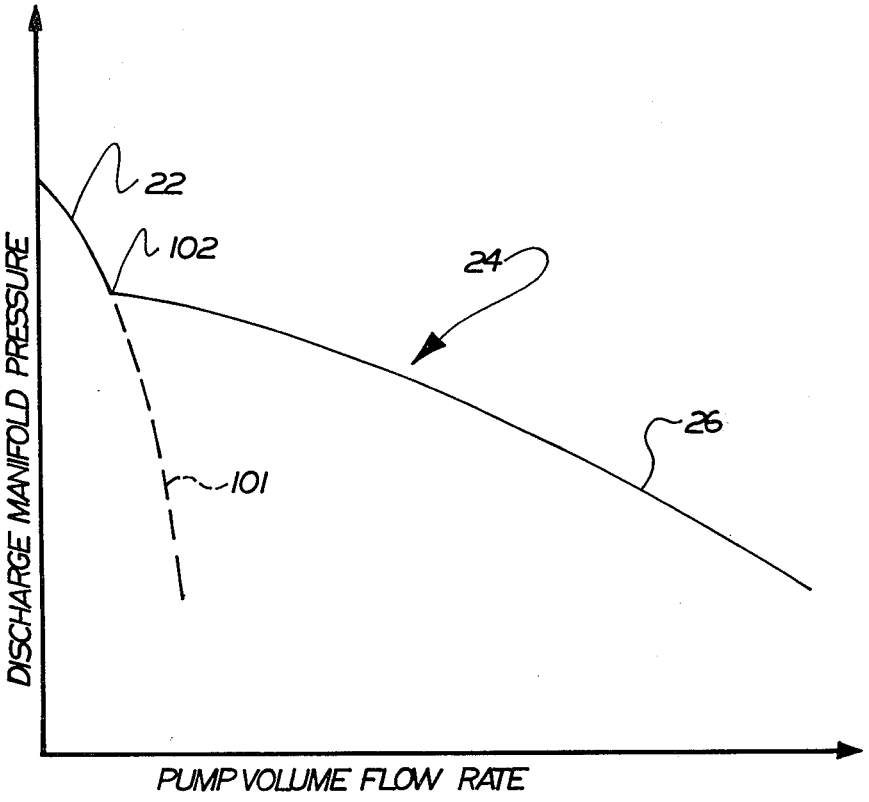
FIG. 2 is a graph illustrating the manner in which the discharge pressure from the booster pump assembly of FIG. 1 varies with variations in fuel flow rate to the engine.

In order to meet these fuel flow and pressure requirements, the output from the booster pump assembly 14 varies in the manner shown by the graph in FIG. 2. During relatively low fuel flow rates, the output from the booster pump assembly is at a relatively high pressure indicated by a low-flow mode portion 22 of the fuel flow rate curve 24. During relatively high fuel flow rates, the output from the booster pump assembly 14 is at a relatively low pressure indicated by a high-flow mode portion 26 of the fuel flow rate curve 24. Thus, as the volumetric fuel flow rate from the booster pump assembly 14 increases, the pressure at which fuel is supplied to the engine 18 decreases.

Figure 3:
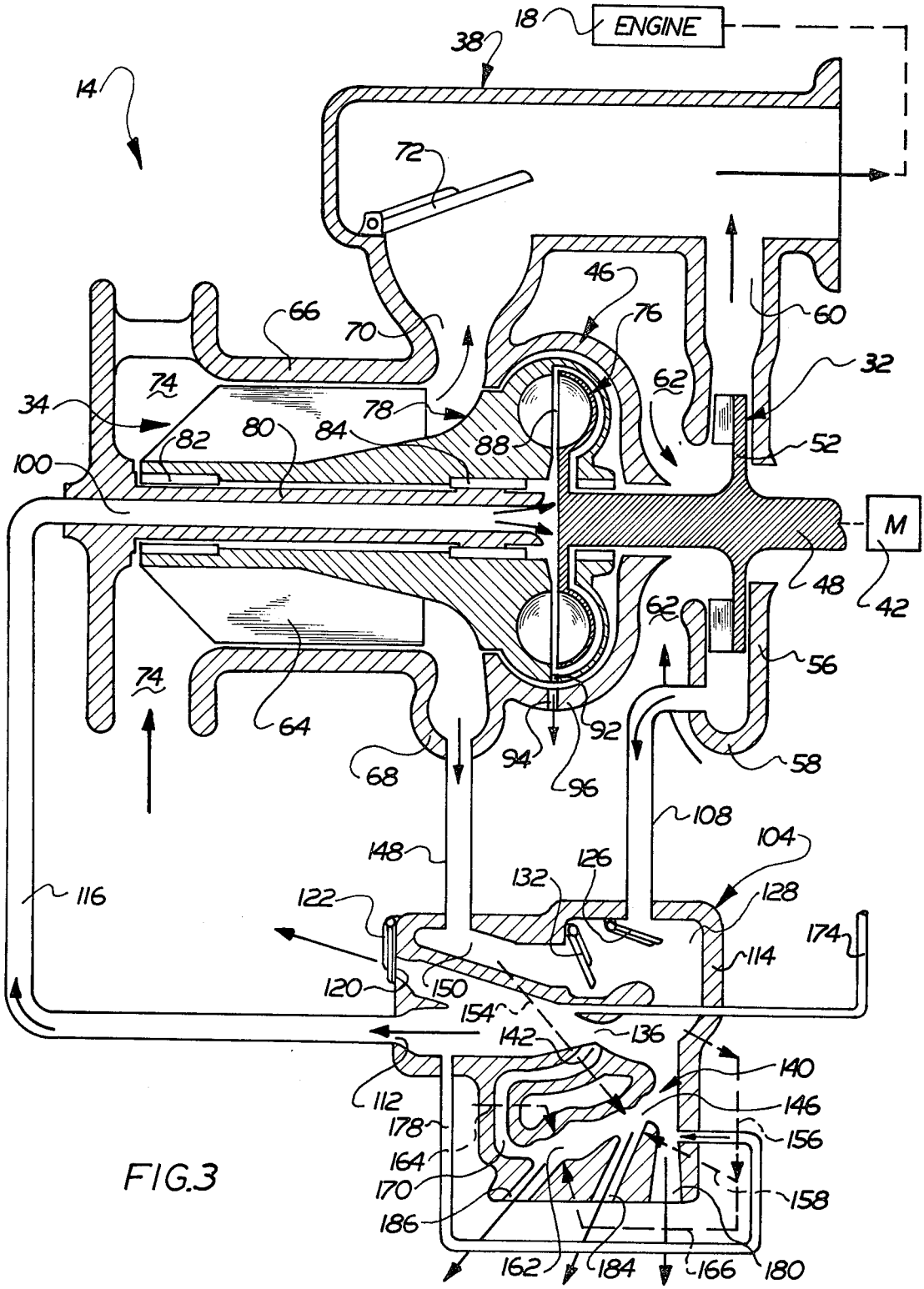
FIG. 3 is an enlarged sectional view illustrating the construction of the booster pump assembly of FIG. 1.

In order to supply fuel in accordance with the pressure and flow rate characteristics illustrated by the curve 24 in FIG. 2, the tank mounted booster pump assembly 14 includes a relatively small centrifugal type pump 32 (FIG. 3) having a low discharge capacity. Although the pump 32 has a relatively low discharge capacity, it is capable of supplying fuel at relatively high pressures. A second relatively large centrifugal type pump 34 having a large discharge capacity is mounted in a coaxial relationship with the small pump 32. Fuel discharged from the small pump 32 is combined with the fuel discharge from the large pump 34 in a conduit or manifold 32 which is connected in fluid communication with the engine 18.

The small pump 32 is continuously driven by an electric motor 42. Although the motor 42 is effective to continuously drive the small pump 32, the motor 42 is effective to drive the large pump 34 only when a fluid coupling or clutch assembly 46 is engaged. The drive forces from both the small pump 32 and large pump 34 are transmitted through a drive shaft 48 which is connected with the motor 42. When the fluid coupling assembly 46 is engaged, drive forces from the shaft 48 are transmitted by the coupling assembly to the large pump 34. It should be noted that the motor 42, small pump 32, coupling assembly 46 and large pump 34 are mounted in a coaxial relationship with each other and are submerged in the fuel tank 12.

The small pump 32 includes a circular impeller 52 which is disposed in a housing 56. Since the small pump 32 is continuously driven by the motor 42, the impeller 52 is integrally formed with the drive shaft 48. The housing 56 has a circular scrolll 58 with an outlet 60 to the discharge manifold 38. Fuel enters the submerged small pump 32 through a circular inlet opening 62 which is exposed to the fuel 16 in the tank 12.

The large pump 34 has a relatively large circular impeller 64 which is disposed in a housing 66. A scroll 68 of the large pump 34 is connected in fluid communication with the discharge manifold 38 through an outlet 70 and check valve 72. The check valve 72 prevents a flow of fuel from the discharge manifold 38 to the large pump 34 when the coupling assembly 46 is disengaged. Fuel enters the submerged fuel pump 34 through a circular inlet opening 74 which is exposed to the fuel 16 in the tank 12.

The fluid coupling assembly 46 includes a circular input or pump element 76 which is connected with the drive shaft 48 and is rotated with the impeller 52 of the small pump 32. The coupling assembly 46 also has a circular output or turbine element 78 which is rotatably supported on a hollow cylindrical spindle shaft 80 by bearings 82 and 84. The output element 78 is integrally formed with the pump impeller 64 and extends around the input element 76.

When the coupling asssebly 46 is in an engaged condition, an annular space 88 between and extending into the coupling elements 76 and 78 is filled with liquid. This liquid is effective to transmit drive forces from the input element 76 to the output element 78. Thus, when the space 88 is filled with liquid, the motor 42 can drive the large pump 34 to supply fuel to the discharge manifold 38 and engine 18.

When the engine fuel requirements are such that they can be supplied by the continuously driven small pump 32, the coupling assembly 46 is disengaged to interrupt operation of the large pump 34 to reduce the power requirements of the booster pump assembly 14. To disengage the coupling assembly 46, the fluid in the annular space 88 is drained through an opening 92 in the driven coupling element 78 and through an opening 94 in the coupling housing 96 which encloses the driving and driven elements 76 and 78.

In accordance with a feature of the present invention, the liquid which is utilized as the working fluid to transmit drive forces from the input coupling element 76 to the output element 78 is the fuel 16. Since the fluid coupling 46 is submerged in the body of fuel in the tank 12, there is a large supply of fuel available to use as the fluid drive medium in the coupling. In addition, emptying the coupling when it is to be disengaged is relatively easy since it is merely necessary to return the drained fuel to the body of fuel in the tank.

When the coupling assembly 46 is to be engaged, fuel is supplied to the space 88 through a central passage 100 which extends through the spindle 80. Fuel discharged from the end of the passage 100 impinges against the input element 76 and flows outwardly to the space 88. Although there is a continuous flow of fuel from the coupling assembly 46 through the relatively small openings 92 and 94, fuel flows through the central passage 100 to the space 88 at a rate which is sufficient to maintain the space full of liquid fuel.

When the coupling assembly is to be disengaged, the flow of fuel through the inlet passage 100 is interrupted. The continuous flow of fuel from the space 88 through the outlet openings 92 and 94 results in the space being drained of liquid. When this occurs, the continuously rotating input element 76 is ineffective to rotate the output element 78 so that the motor 42 is ineffective to drive the large pump 34. When operation of the large pump 34 is interrupted, the fluid pressure in the output passage 70 decreases and the check valve 72 is closed by the relatively high discharge pressure from the small pump 32.

The coupling assembly 46 is operated between the engaged and disengaged conditions by a control assembly 104 in response to changes in demand for fuel by the engine 18. Changes in the demand for fuel by the engine 18 results in changes in the pressure in the discharge from the small pump 32 and the discharge manifold 38. Thus, when there is a demand for fuel at a relatively low flow rate and high pressure, as indicated by the portion 22 on the curve 24 in FIG. 2, the small pump 32 has a relatively high discharge pressure. Similarly, when the engine 18 requires fuel at a relatively high flow rate and low pressure, as indicated by the portion 26 on the curve 24, the output pressure from the small pump 32 is relatively low.

The fuel flow rate and discharge pressure from the small pump 32 are depicted by the low flow mode portion 22 of the curve 24 and the curve indicated in dashed lines at 101 in FIG. 2. The point at which the large pump 34 is activated by engaging the coupling 46 is indicated at 102 in FIG. 2. The combined outputs from the two pumps 32 and 34 is indicated by the high flow mode portion 26 of the curve 22.

A coupling control assembly 104 is connected with the scroll 58 of the small pump 32 by a conduit 108. The conduit 108 conducts fuel to the control assembly 104 at a pressure which varies in the same manner as does the output pressure from the small pump 32. Variations in the output pressure from the small pump 32 are sensed by the control assembly 104 to effect engagement of the coupling assembly 46 in response to a decrease in the output pressure of the pump 32 and to effect disengagement of the coupling assembly 46 in response to an increase in the output pressure from the small pump.

To effect engagement of the coupling assembly 46, the control assembly directs a stream of fuel from the small pump 32 through a discharge opening 112 in a control assembly housing 114. The fuel from the control assembly outlet 112 is conducted to the spindle passage 100 through a conduit 116. Thus, to engage the coupling assembly 46, the control assembly 104 directs fuel from the small pump 32 to the conduit 116 which is connected with the space 88 between the input and output elements 76 and 78 of the coupling assembly 46 through the spindle passage 100.

When the coupling assembly 48 is to be disengaged, the fuel which flows from the small pump 32 to the control assembly 104 is directed back to the tank through an opening 120 in the control assembly housing 114. This interrupts the supply of fuel to the space 88 in the coupling assembly 46 so that the space is emptied as fuel is drained through the openings 92 and 94 in the coupling assembly. It should be noted that the control assembly 104 is submerged in the body of fuel in the tank 12. Therefore, a check valve 122 extends across the opening 120 to prevent fuel from flowing into the housing 114 through the discharge outlet 120 when the coupling is in an engaged condition.

When the coupling assemby 46 is disengaged, the small pump 32 is effective to supply fuel at a relatively high pressure and low flow rate to the engine 18. Since the coupling 46 is disengaged, the large pump 34 is not being driven by the motor 42 and the check valve 72 is closed to prevent a flow of fuel back to the inactive pump 34. When the coupling 46 is disengaged, the space or chamber 88 between the input member 76 and output member 78 is empty of liquid fuel so that rotation of the input member 76 by the motor 42 is ineffective to drive the output member 78.

When only the small pump 32 is being utilized to supply fuel and the fluid coupling assembly 46 is disengaged, the control assembly 104 is effective to direct a flow of fuel from the small pump 32 through the opening 120 and check valve 122 back to the body of fuel 16 in the tank 12. At this time, fuel at a relatively high pressure flows through the conduit 108 and open check valve 126 to a chamber 128 in the housing 114. Since the pump 34 is ineffective to supply fuel to the control assembly 104, a check valve 132 is closed due to the pressure of the fuel in the chamber 128 to prevent a flow of fuel to the inactive pump 34.

The high pressure fuel from the small pump 32 flows to a nozzle 136. The nozzle 136 is effective to direct a stream of fuel toward either the opening 112 or the opening 120.

When the coupling assembly 46 is disengaged, the stream of fuel from the nozzle 136 is directed toward the opening 120 and through the open check valve 122 back to the body of fuel in the tank 12. To direct the stream of fuel from the nozzle 136 toward the opening 120, a fluidic amplifier 140 provides a control jet which is directed through an opening 142 toward the stream of fuel passing through the nozzle 136. The control jet is effective to deflect the stream of fuel upwardly (as viewed in FIG. 3) toward the opening 120 leading to the tank.

The fluidic amplifier 140 includes a control passage 146 where the fuel pressure from the small pump 32 is compared with the fuel pressure from the large pump 34. Thus, the discharge pressure from the large pump 34 is conducted through a conduit 148 to a cavity 150 in the chamber 128. Since the check valve 132 is closed, the cavity 150 is not communicated with the relatively high pressure from the small pump 32. The low pressure from the inactive large pump 34 is conducted through a small control passage, indicated schematically at 154, to the upper side of the control passage 146. Similarly, the relatively high pressure output from the small pump 32 is conducted through passages indicated schematically at 156 and 158 to the lower side of the control passage 146. Since at this time the discharge pressure from the pump 32 is relatively low, the control jet from the passage 158 is effective to deflect the stream of fuel flowing through the passage 146 upwardly (as viewed in FIG. 3). The fluid pressure in the tank 12 is compared with the fluid pressure from the small pump 32 at a second control passage 162. Thus, tank pressure is conducted through a passage indicated schematically at 164 to the upper side of the control passage 162. The relatively high fluid pressure output from the pump 32 is conducted through a passage indicated schematically at 166 to the lower side of the control passage 162. During normal operation of the pump 32, this output pressure will be substantially greater than tank pressure so that the stream of fuel passing through the control passage 162 is deflected upwardly (as viewed in FIG. 3) toward a passage 170 leading to the control jet outlet 142. The relatively high fluid pressure at the control jet outlet 142 is effective to deflect the stream of fuel being conducted through the nozzle 136 upwardly toward the passage 120 leading to tank.

If for some reason the small pump 32 should fail to provide its normal output pressure, the pressure differential across the passage 162 would be ineffective to direct the control stream upwardly. Therefore, the stream of fuel through the nozzle 136 would not be deflected by a control jet at opening 142. This would result in the coupling 46 being supplied with fuel to drive the large pump 34.

In order to promote an emptying of liquid fuel from the fluid coupling assembly 46 and disengagement of the coupling assembly, the control assembly 104 connects coupling chamber or space 88 with the tank ullage, that is the space 172 (FIG. 1) above the level of the body of liquid fuel 16 in the tank 12. To this end, a conduit 174 (FIG. 3) extends from a location above the level of fuel in the tank 12 to a location adjacent to the nozzle 136 toward which this stream of fuel is, at the present time, being directed toward the outlet opening 120. The relatively low pressure air from the conduit 174 enables the stream of fuel to be readily deflected from the outlet opening 112 to the outlet opening 120 by the control jet at the opening 142.

The space 88 in the disengaged coupling assembly 46 is vented to the tank ullage. Thus a gas, that is air, is conducted through the opening 112 and conduit 116 to the space or chamber 88 in the coupling assembly. By venting the space or chamber 88 to atmosphere, the chamber can be emptied of liquid fuel through the passages 92 and 94 without forming a partial vacuum in the chamber. Of course, this greatly facilitates emptying of the liquid fuel from the coupling assembly 46 when the coupling assembly is to be operated from the engaged condition to the disengaged condition. Although it is preferred to connect the conduit 174 with the portion of the fuel tank above the body of fuel 16, it should be understood that it may be desirable to connect the vent conduit 174 with atmosphere in a different way.

It is contemplated that excess fuel may tend to accumulate in the area adjacent to the opening 112 in the control assembly 104. This excess fuel is drawn off through a suction conduit 178 leading to a drain passage 180.

When the output pressure from the small pump 32 decreases due to an increased demand for fuel by the engine 18, the fluid coupling 46 is engaged to drive the large pump 34. Thus, when the fluid pressure from the small pump 32 decreases, the pressure differentials across the passages 146 and 162 in the amplifier 140 of the control assembly 104 decrease. This results in fuel being directed from the passages 146 and 162 to drain passages 184 and 186 leading to the body of fuel 16 in the tank 12.

When this occurs, the control jet at the opening 142 is interrupted so that the stream of fuel from the nozzle 136 is directed straight leftwardly (as viewed in FIG. 3) towards the opening 112. The stream of high pressure fuel which is supplied by the small pump 32 is conducted to the conduit 116 through the chamber or space 88 in the fluid coupling assembly 46. The rate at which fuel is conducted to the coupling chamber 88 is substantially greater than the rate at which it can be drained from the chamber through the passages 92 and 94. Therefore, the chamber 88 fills with liquid fuel which is supplied, through the control assembly 104, by the small pump 32. As the liquid fuel fills the coupling chamber 88, the continuously driven input member 76 causes the liquid fuel to transmit drive forces to the output member 78 to drive the relatively large capacity pump 34.

As the fluid pressure from the large pump 34 increases, the check valve 72 is opened and the output from the large pump 34 is added to the output from the small pump 32 to supply the engine fuel requirements. It should be noted that when the large pump 34 is being driven through the coupling assembly 46, the check valve 132 is opened so that there is a substantial volume of fuel to supply the nozzle 136 and the coupling chamber 88. However, the total volume of fuel required to maintain the coupling chamber 88 filled during operation of both of the pumps is less than one percent of the total output from the two pumps 32 and 34.

When the fluid coupling 46 is engaged and the stream of fuel from the nozzle 136 in the control assembly 134 is being directed to the outlet 112, the tank ullage is connected with the outlet opening 120 through the vent pipe 174. Therefore, the pressure of the liquid fuel in which the control assembly 104 is submerged is effective to shut the check valve 122. It should be noted that any excess fuel which enters the area around the outlet openings 112 and 120 is drawn off through the suction conduit 178 leading to the discharge passage 180.

When the demand for fuel by the engine 18 decreases, the output pressure from the pump 32 exceeds the output pressure from the pump 34. This is due to the fact that the centrifugal pump 32 has a housing 56, scroll 58 and discharge passage 60 which are designed and sized to provide a relatively high fluid pressure output while the housing 66, scroll 68 and discharge passage 70 for the large capacity pump 34 are designed to enable a larger volume of liquid to be discharged from the pump at a somewhat lower pressure. Therefore, when the demand for fuel by the engine 18 decreases, the output pressure from the pump 32 increases. This increased output pressure results in an increased pressure differential across the control passages 146 and 162 in the fluidic amplifier 140.

The increased pressure differential across the amplifier control passages 146 and 162 causes the control jet to be directed away from the drain passages 184 and 186 to the passage 170 leading to the control jet opening 142. The jet of fuel from the opening 142 is effective to deflect the stream of fuel flowing through the nozzle 136 upwardly to the outlet 120 through the check valve 122 to the tank. As this occurs, the coupling chamber 88 is connected with the vent conduit 174 to enable the liquid fuel in the coupling chamber to be quickly drained through the passages 92 and 94. Therefore, when the demand for fuel by the engine 18 decreases, the fluid coupling 46 is disengaged to render the large pump 34 inactive. Of course, disengaging the fluid coupling 46 reduces the load on the motor 42 and reduces the amount of power required to drive the booster pump assembly 14.

In view of the foregoing it is apparent that the present invention relates to a new and improved apparatus for supplying fuel to an engine 18 and more specifically to a tank mounted booster pump assembly 14 which conserves energy by operating efficiently during both low and high fuel flow rates to an aircraft engine. In order to accomplish this, the improved booster pump assembly 14 includes a relatively small pump 32 and a relatively large pump 34. When engine fuel flow requirements are relatively low, only the relatively small, low flow capacity pump 32 is operated to supply the engine 18 with fuel. When the engine fuel requirements are relatively high, such as during take off and/or during afterburner operation, both the small pump 32 and the relatively large pump 34 are operated to supply fuel to the engine.

To enable the relatively large pump 34 to be rendered inactive during engine operating conditions requiring a relatively low fuel flow rate, the large pump is connected with the booster pump drive motor 42 through a fluid coupling assembly 46. During low fuel flow operating conditions, the fluid coupling assembly 46 is drained and the motor 42 is used to drive only the small pump 32. When the fuel flow requirements increase, liquid is supplied to the fluid coupling assembly 46 to connect the relatively large pump 34 with the motor 42.

In accordance with a feature of the present invention, fuel is utilized as the liquid which is supplied to the fluid coupling assembly 46. The use of fuel as the fluid which transmits drive forces in the coupling assembly 46 is believed to be particularly advantageous since the entire booster pump assembly 14 is submerged in the body of fuel in the tank 12. This eliminates the need to conduct liquid from a separate source to the coupling assembly 46 when the coupling assembly is to be engaged.

Although many different types of control devices could be utilized to effect engagement and disengagement of the coupling assembly 46, a fluidic control assembly 104 is advantageously used due to its reliability in operation and lack of moving components. When the coupling assembly 46 is to be engaged, the fluidic control assembly 104 directs a stream of fuel from the relatively small pump 32 to the fluid coupling assembly. When the coupling assembly is to be disengaged, the stream of fuel is directed back to the tank and the coupling assembly 46 is vented.

Having described one specific preferred embodiment of the invention, the following is claimed:

1. An apparatus for supplying fuel to an engine, said apparatus comprising tank means for holding a body of liquid fuel which is supplied to the engine during operation of the engine, first pump means submerged in the body of liquid fuel in said tank means for pumping fuel from said tank means, motor means submerged in the body of liquid fuel in said tank means for driving said first pump means, fluid coupling means submerged in the body of fuel in said tank means and connected with said motor means and said first pump means for transmitting drive forces from said motor means to said first pump means, said fluid coupling means including an input member connectd with said motor means, an output member connected with said first pump means, and chamber means for holding fuel which transmits drive forces from said input member to said output member during operation of said motor means, and control means submerged in the body of fuel for effecting operation of said fluid coupling means between an engaged condition in which said fluid coupling means is effective to transmit drive forces between said motor means and said first pump means and a disengaged condition in which said coupling means is ineffective to transmit drive forces from said motor means to said first pump means, said control means including means for directing a flow of fuel from the body of fuel to said chamber means during operation of said coupling means from the disengaged condition to the engaged condition and for directing a flow of a gas from outside of the body of fuel to said chamber means during operation of said coupling means from the engaged condition to the disengaged condition.

2. An apparatus as set forth in claim 1 further including conduit means for conducting gas from a portion of said tank means above the body of liquid fuel to said chamber means during operation of said coupling means from said engaged condition to said disengaged condition.

3. An apparatus as set forth in claim 1 further including second pump means submerged in the body of liquid fuel in said tank means and connected with said motor means for pumping fuel from said tank means, said control means including means for directing a flow of fuel under pressure from said second pump means to said chamber means during operation of said coupling means from the disengaged condition to the engaged condition.

4. An apparatus as set forth in claim 3 wherein said control means further includes means for directing a flow of fuel from said second pump means to the body of liquid fuel in said tank means during operation of said coupling means from the engaged condition to the disengaged condition.

5. An apparatus as set forth in claim 3 wherein said control means includes means for effecting operation of said coupling means from said disengaged condition to the engaged condition in response to a decrease in the pressure of the fuel discharged from said second pump means.

6. An apparatus as set forth in claim 1 further including passage means for conducting a flow of liquid fuel from said chamber means to the body of liquid fuel in said tank means upon operation of said fluid coupling means from the engaged condition to the disengaged condition.

7. An apparatus for supplying fuel to an engine, said apparatus comprising a first pump having a relatively small flow capacity, means for driving said first pump to discharge fuel to the engine, a second pump having a relatively large flow capacity, coupling means for transmitting drive forces to said second pump, said coupling means being operable between a first condition in which said coupling means is ineffective to transmit force to said second pump and a second condition in which said coupling means is effective to transmit force to said second pump to effect operation of said second pump to discharge fuel to the engine, said coupling means including a fluid coupling assembly having an input member and an output member which is spaced from said input member and is connected with said second pump, and control means for effecting operation of said coupling means from the first condition to the second condition in response to a decrease in the pressure of the fuel discharged from said first pump, said control means including means for supplying fuel to the space between said input and output members of said fluid coupling assembly to transmit drive forces between said input and output members through the fuel in the space between the input and output members when said coupling means is in the second condition.

8. An apparatus as set forth in claim 7 further incuding conduit means for conducting fuel discharged from said first pump to said fluid coupling assembly.

9. An apparatus as set forth in claim 8 wherein said means for driving said first pump includes an electric motor connected with said first pump, said coupling means being effective to transmit drive forces from said electric motor to said second pump when said coupling means is in the second condition.

10. An apparatus as set forth in claim 7 further including conduit means for conducting a gaseous medium to the space between said input and output members when said coupling means is in the first condition.

11. An apparatus for supplying fuel to an engine, said apparatus comprising a tank containing liquid fuel, first pump means disposed in said fuel tank for directing a flow of fuel to the engine, second pump means disposed in said fuel tank for directing a flow of fuel to the engine when the demand for fuel by the engine exceeds the output from the first pump means, motor means disposed in said fuel tank for driving said first and second pump means, means for connecting said motor means with said first pump means to continuously drive said first pump means during operation of said motor means, coupling means disposed in said fuel tank for transmitting drive forces from said motor means to said second pump means, said coupling means being operable between a first condition in which said coupling means is ineffective to transmit drive forces from said motor means to said second pump means and a second condition in which said coupling means is effective to transmit drive forces from said motor means to said second pump means, said coupling means including a fluid coupling assembly having an input member connected with said motor means and an output member connected with said second pump means, and control means for effecting operation of said coupling means from the first condition to the second condition in response to the demand for fuel by the engine exceeding the rate at which fuel is discharged from said first pump means, said control means including means for supply fuel to said fluid coupling assembly to transmit drive forces between said input and output members through the fuel when said coupling means is in the second condition.

12. An apparatus as set forth in claim 11 wherein said control means includes means for conducting a gaseous medium to said fluid coupling assembly when said coupling means is in the first condition.

13. An apparatus as set forth in claim 11 wherein said apparatus includes means for supplying a flow of fuel from said first pump means to said control means, said control means including means for directing the flow of fuel from said first pump means to said fuel tank when said coupling means is in the first condition and for directing the flow of fuel from said first pump means to a space between said input and output members of said fluid coupling assembly when said coupling means is in the second condition.

* * * * *